US007225577B1

(12) United States Patent
Wang

(10) Patent No.: US 7,225,577 B1
(45) Date of Patent: Jun. 5, 2007

(54) STRUCTURE FOR FIXING GUN'S AIMING DEVICE

(76) Inventor: Margaret Wang, 2318 Bluehaven Dr., Rowland Heights, CA (US) 91748

( * ) Notice: Subject to any disclaimer, the term of this patent is extended or adjusted under 35 U.S.C. 154(b) by 0 days.

(21) Appl. No.: 11/284,822

(22) Filed: Nov. 23, 2005

(51) Int. Cl.
*F41G 1/38* (2006.01)

(52) U.S. Cl. ..... 42/124; 42/127

(58) Field of Classification Search ..... 42/124, 42/125, 126, 127, 128, 146
See application file for complete search history.

(56) References Cited

U.S. PATENT DOCUMENTS

| | | | | |
|---|---|---|---|---|
| 4,905,396 | A * | 3/1990 | Bechtel | 42/127 |
| 6,622,415 | B1 * | 9/2003 | Canaday et al. | 42/140 |
| 2002/0100204 | A1 * | 8/2002 | Kim | 42/146 |
| 2005/0246937 | A1 * | 11/2005 | Kim | 42/146 |
| 2005/0257415 | A1 * | 11/2005 | Solinksy et al. | 42/146 |
| 2005/0279004 | A1 * | 12/2005 | Woodmansee et al. | 42/146 |
| 2006/0010759 | A1 * | 1/2006 | Penney | 42/126 |
| 2006/0156609 | A1 * | 7/2006 | Kim | 42/124 |

* cited by examiner

*Primary Examiner*—Michael J. Carone
*Assistant Examiner*—Benjamin P. Lee
(74) *Attorney, Agent, or Firm*—Rosenberg, Klein & Lee

(57) ABSTRACT

A structure for fixing an aiming device includes a fixing base, a rotatable disk, a locking bolt, and two elastic components. The fixing base is departably attached to the gun. The rotatable disk is rotatably disposed at a bottom of the fixing base and has two wedge-shaped components. Each of the wedge-shaped components has a slope with a higher end having a position-fixing concave. The locking bolt has position-fixing blocks. When the higher ends of the two wedge-shaped components are moved to the underneath of the locking bolt, the locking bolt is pushed upward into the fixing slot of the gun and the position-fixing blocks are placed into the position-fixing concaves. When the lower ends of the two wedge-shaped components is moved to the underneath of the locking bolt, the locking bolt is pushed downward by the two elastic components and thus departed from the fixing slot of the gun.

9 Claims, 6 Drawing Sheets

STRUCTURE FOR FIXING GUN'S AIMING DEVICE

BACKGROUND OF THE INVENTION

1. Field of the Invention

The present invention is related to a structure for fixing a gun's aiming device, and more particularly, to a structure that is used to attach an aiming device to a gun. The structure of the present invention has better fixing capability and is easier to be detached from a gun or attached thereto.

2. Description of Related Art

Conventional aiming devices, such as laser aiming devices, can be attached to guns. Light emitted from the aiming devices helps people to aim a target. The aiming devices need to be attached to barrels of guns by proper fixing structures.

Reference is made to FIG. 1. A conventional aiming device 8 is attached to a gun by a fixing structure. The fixing structure 9 includes a fixing base 91, a rotatable disk 2, and a locking bolt 93. The rotatable disk 92 is pivoted at the bottom of the fixing base 91 and projects from two sides of the fixing base 91. Hence, one can use his fingers to rotate the rotatable disk 92. The top of the rotatable disk 92 has two wedge-shaped components 921 projecting therefrom. The locking bolt 93 is disposed inside the fixing base 91 and can be moved upward or downward. The tops of the two wedge-shaped components 921 contact a lower end of the locking bolt 93. In this way, the two wedge-shaped components 921 can be used to control the locking bolt 93 to move upward or downward.

The aiming device 8 can be attached to a gun (not shown) by the two directing tracks 911 formed on the top of the fixing base 91 of the fixing structure 9. Rotating the rotatable disk 92 can make the locking bolt 93 move to the higher ends of the two wedge-shaped components 921. In this way, the locking bolt 93 can be moved upward to a higher position and pushed into corresponding fixing slots (not shown) of the gun. And the aiming device 8 can be fixed on the barrel of the gun.

When the rotatable disk 92 is rotated in the opposite direction, the locking bolt 93 is moved to the lower ends of the two wedge-shaped components 921 due to gravity. In this way, the locking bolt 93 is moved downward to a lower position and departs from the fixing slots of the gun. Thus, the aiming device 8 can be detached from the gun.

However, in the above-mentioned fixing structure 9, the locking bolt 93 is moved upward by the two wedge-shaped components 921 of the rotatable disk 92 to make the fixing structure 9 attached to the gun. Since there is no fixing mechanism provided between the two wedge-shaped components 921 and the locking bolt 93, the relative movement occurs easily. Hence, it is difficult to fix the locking bolt firmly in the fixing slots of the gun and the aiming device 8 is thus easy to move from the original position. Especially, when percussion is performed, the recoil of gun is usually very large and the movement of the aiming device 8 occurs even more easily.

Furthermore, when one wants to detach the aiming device 8 from the gun, the locking bolt 93 is moved to the lower position by gravity. Since the locking bolt 93 may be stuck due to friction force or other reasons and cannot be moved downward, it is usually difficult to detach the aiming device 8 from the gun speedily.

Accordingly, as discussed above, the prior art still has some drawbacks that could be improved upon. The present invention aims to resolve the drawbacks of the prior art.

SUMMARY OF THE INVENTION

An objective of the present invention is to provide a structure for fixing an aiming device to a gun. The fixing structure of the present invention has position-fixing blocks and position-fixing concaves for firmly fixing the locking bolt on two wedge-shaped components of the rotatable disk. In this way, the locking bolt can stay in a predetermined position to make the aiming device firmly attached to the gun.

In addition, when one needs to detach the aiming device from the gun, two elastic components of the fixing structure are used to push the locking bolt downward to the lower position and thus surely depart the locking bolt from the fixing slot of the gun. In this way, the aiming device can be detached from the gun speedily.

For achieving the objective above, the present invention provides a structure for fixing an aiming device on a gun. In other words, the fixing structure is used for attaching the aiming device to the gun. Therein, the gun has a fixing slot. The fixing structure includes a fixing base, a rotatable disk, a locking bolt, and two elastic components. The fixing base is disposed fixedly on a top of the aiming device and has a containing room. The fixing base is departably attached to the gun. The rotatable disk is rotatably disposed at a bottom of the fixing base and has two wedge-shaped components projecting therefrom. Each of the wedge-shaped components has a slope. The slope has a higher end and a lower end. The higher end of the slope has a position-fixing concave. The locking bolt is disposed within the containing room of the fixing base and capable of being moved upward or downward therein. The locking bolt has a lower portion with position-fixing blocks. The two elastic components are disposed between the fixing base and the locking bolt.

Therein, when the rotatable disk is rotated to make the higher ends of the two wedge-shaped components move to the underneath of the locking bolt, the two wedge-shaped components push the locking bolt upward into the fixing slot of the gun and the position-fixing blocks are placed into the position-fixing concaves. Moreover, when the rotatable disk is rotated to make the lower ends of the two wedge-shaped components move to the underneath of the locking bolt, the locking bolt is pushed downward to a lower position by the two elastic components and thus departed from the fixing slot of the gun.

Numerous additional features, benefits and details of the present invention are described in the detailed description, which follows.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DETAILED DESCRIPTION OF PREFERRED EMBODIMENTS

Figure 1:
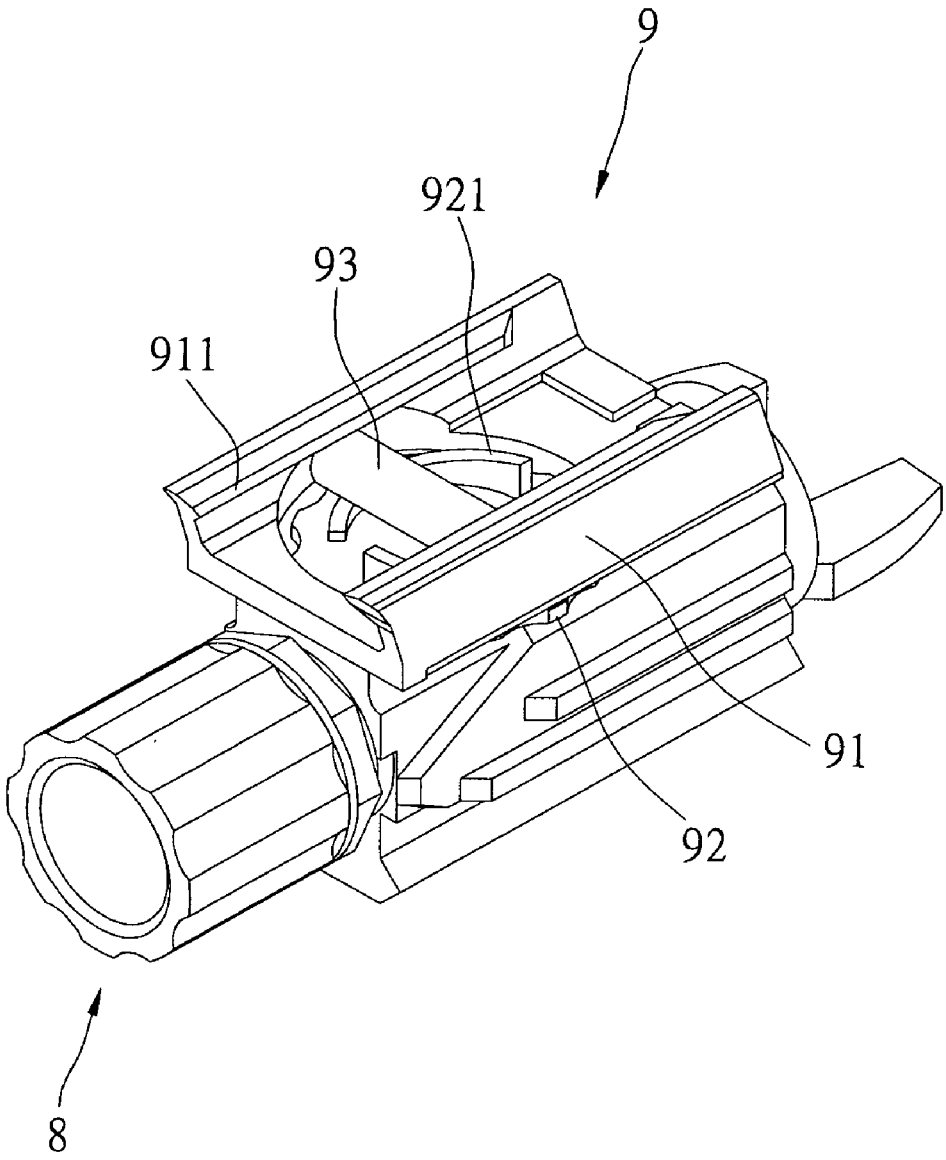
FIG 1 PRIOR ART
FIG. 1 is schematic diagram of a conventional structure for fixing an aiming device on a gun.
Figure 2:
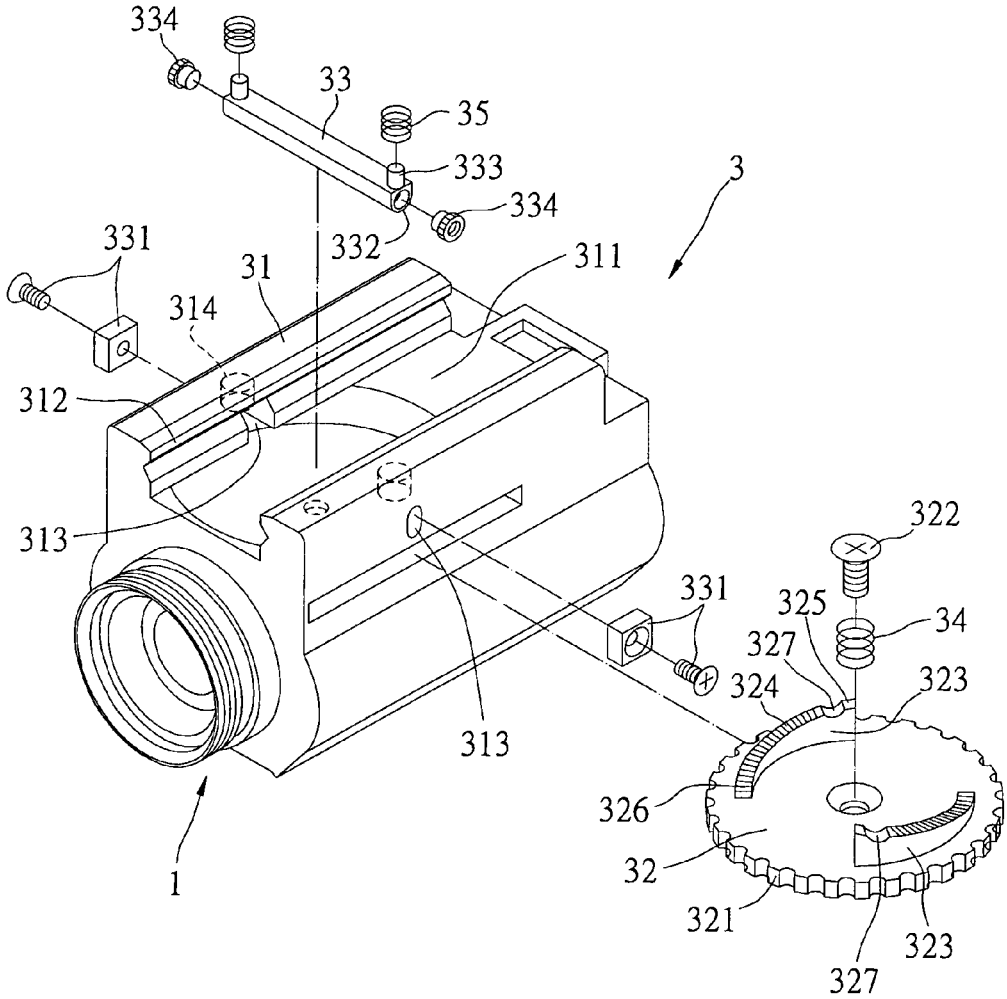
FIG. 2 is an exploded view of the present invention.
Figure 3:
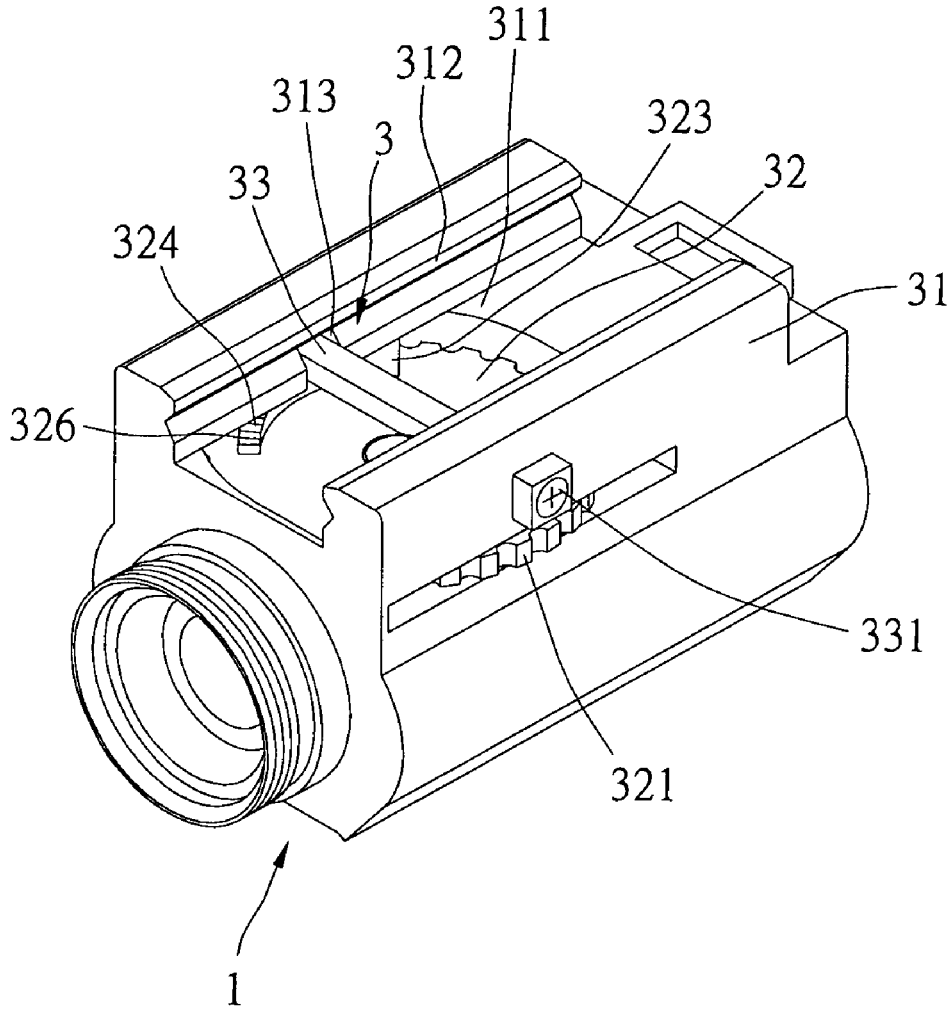
FIG. 3 is a combined view of the present invention.
Figure 4:
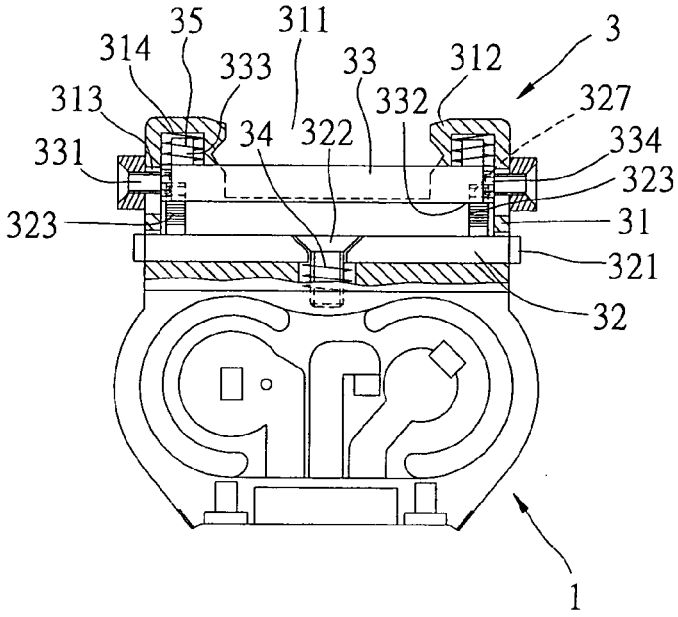
FIG. 4 is a rear cross-sectional view of the present invention.
Figure 5:
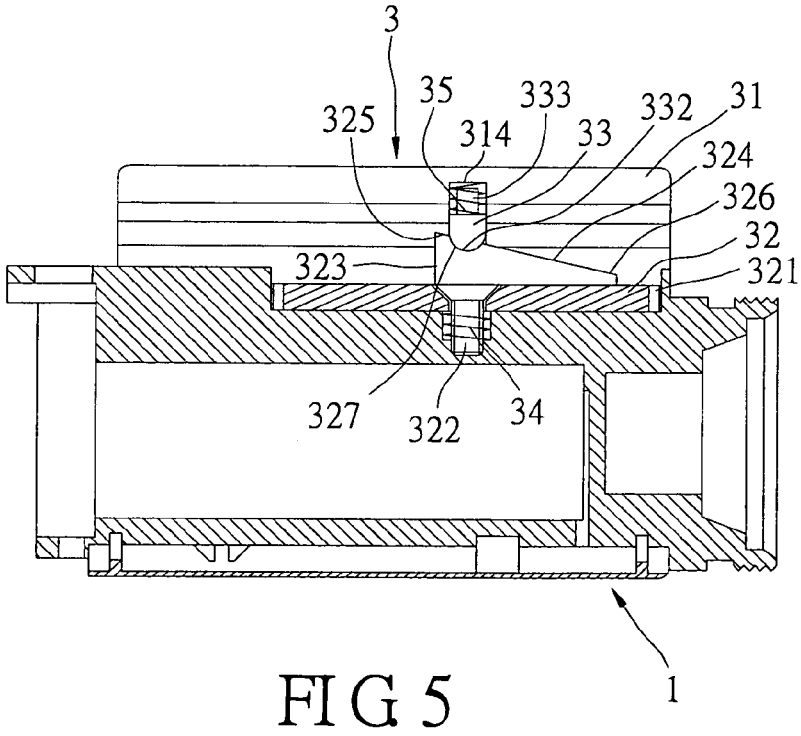
FIG. 5 is a lateral cross-sectional view of the present invention.
Figure 6:
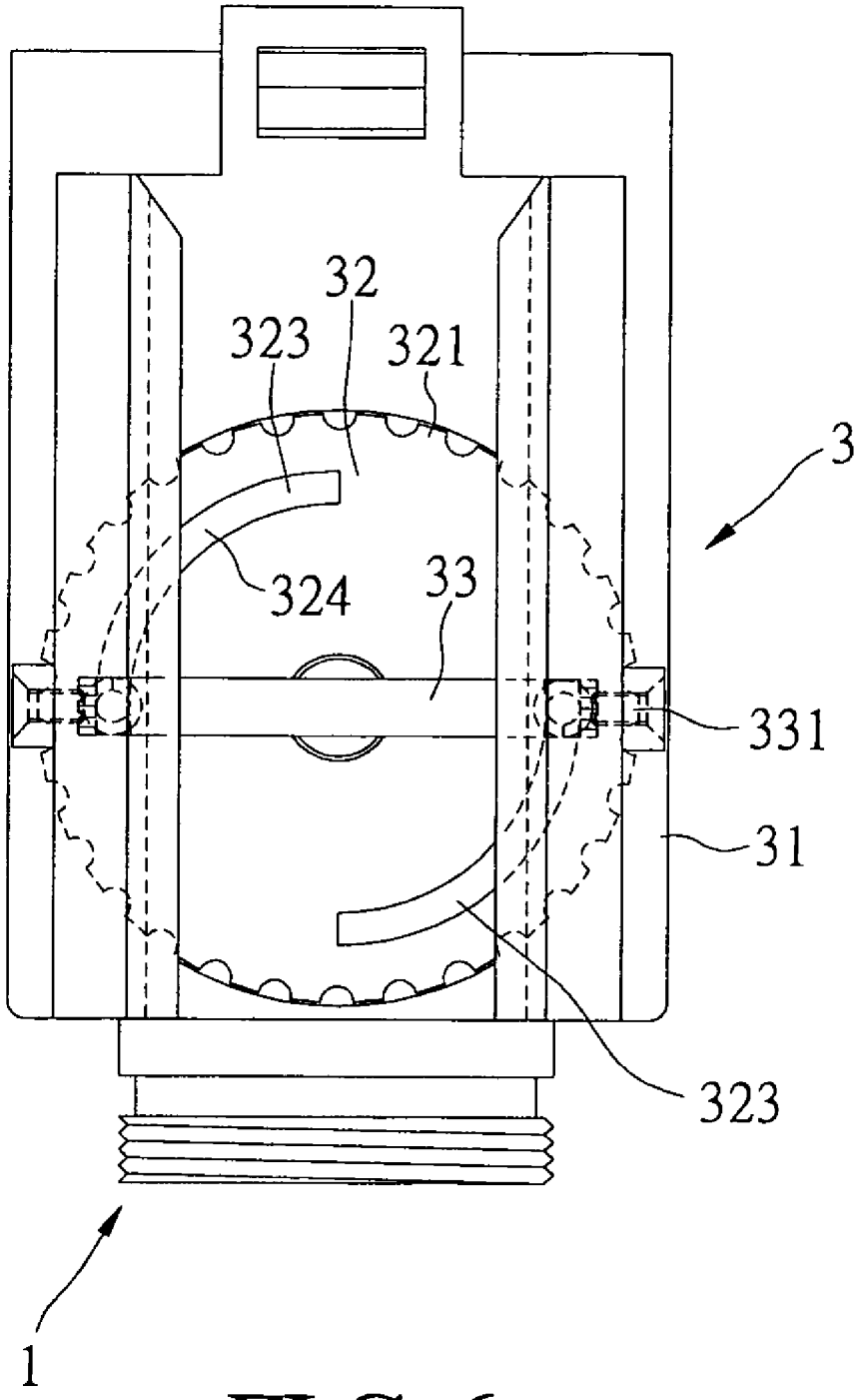
FIG. 6 is a top view of the present invention.
Figure 7:
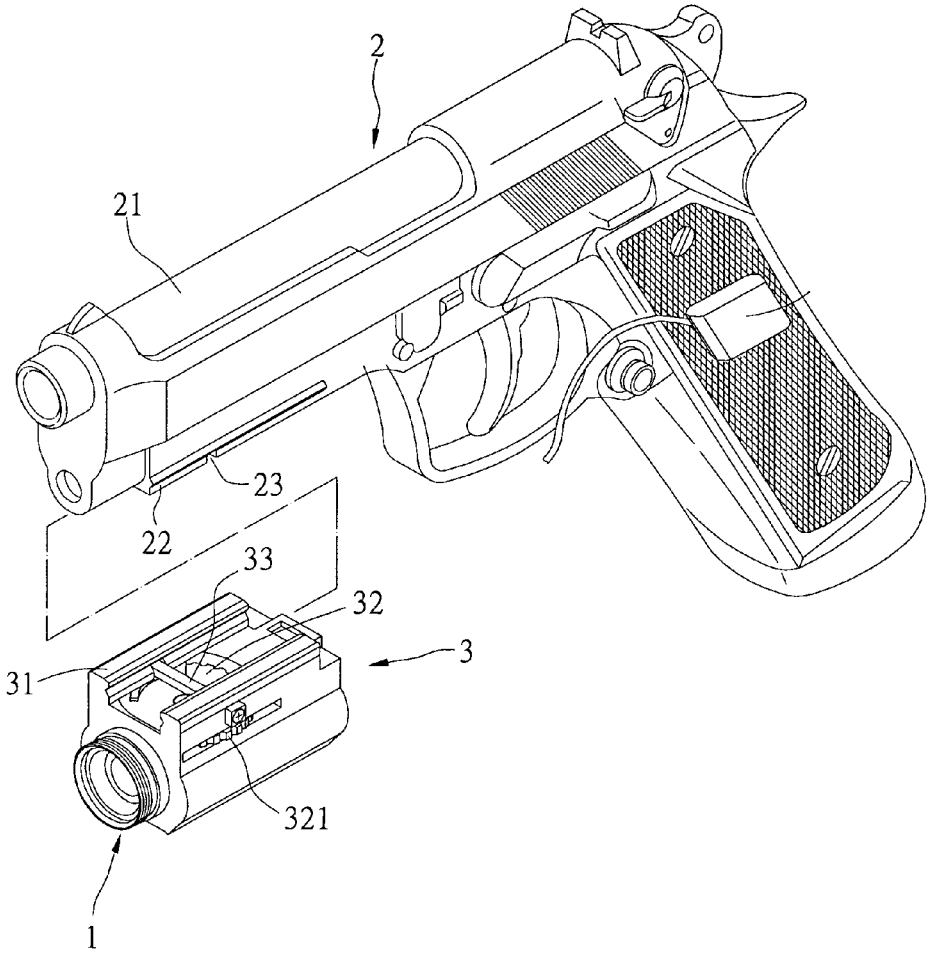
FIG. 7 is an elevation view for showing how the aiming device be attached to the gun using the fixing structure of the present invention.

Reference is made to FIGS. 2–7, which show a structure for fixing an aiming device on a gun in accordance with the present invention. As shown in these figures, a fixing structure 3 is used for attaching an aiming device 1 to a gun 2. The fixing structure is located between the aiming device 1 and the gun 2 when attachment is completed. The fixing structure 3 includes a fixing base 31, a rotatable disk 32, a locking bolt 33, a first elastic component 34 and two second elastic components 35. Therein, the fixing base 31 is fixed on the top of the aiming device 1. A containing room 311 is formed on the top of the fixing base 31. The containing room 311 has openings on its top, front end, and rear end for containing the rotatable disk 32 and the locking bolt 33. The containing room 311 has a pair of first directing tracks 312 formed at two sides thereof. The fixing base 31 can be attached to the bottom of the barrel 21 of the gun 2 by using a pair of second directing tracks 22 corresponding to the first directing tracks 31. The second directing tracks 22 are formed along the barrel 21. Hence, the fixing base 31 and the aiming device 1 can be attached to the gun 2 along the barrel 21.

The rotatable disk 32 is round and has multiple indentations 321 formed periodically thereon. Due to the indentations 321, one can rotate the rotatable disk 32 easily. A pivotal component 322, such as a screw, is passed through the center of the rotatable disk 32 and fixed on the top of the aiming device 1. In this way, the rotatable disk 32 is disposed rotatably between the bottom of the fixing base 31 and the top of the aiming device 1. The outer edge of the rotatable disk 32 projects from two sides of the fixing base 31. Hence, one can rotate the rotatable disk 32 easily. The top of the rotatable disk 32 has two wedge-shaped components 323 projecting therefrom. The two wedge-shaped components 323 are disposed oppositely and each of them has a slope 324. The slope has two ends forming with a higher end 325 and a lower end 326. The slope 324 is sawtooth-shaped. The first elastic component 34 is a spring. The first elastic component 34 is slipped on the pivotal component 322 and located between the aiming device 1 and the rotatable disk 32. The lower end of the first elastic component 322 is placed on the top of the aiming device 1 and the upper end of the first elastic component 322 butts against the bottom of the rotatable disk 32. The elasticity of the first elastic component 34 is used to push the rotatable disk 32 upward so that the two wedge-shaped components 323 disposed on the top of the rotatable disk 32 can firmly contact the lower portion of the locking bolt 33.

The locking bolt 33 is a rectangular parallelepiped substantially. It is disposed horizontally in the containing room 311 of the fixing base 31. The two ends of the locking bolt 33 connect respectively to two sliding components 331. The containing room 311 of the fixing base 31 has two sides formed with sliding slots 313. The sliding components 331 connecting to the two ends of the locking bolt 33 are disposed within the sliding slots 313 and can be moved upward or downward therein. In this way, the locking bolt 33 is disposed within the containing room 311 of the fixing base 31 and can be moved upward or downward therein.

Lower portions of the two ends of the locking bolt 33 have position-fixing blocks 332. The higher ends 325 of the slopes 324 of the two wedge-shaped components 323 have position-fixing concaves 327 corresponding to the position-fixing blocks 332. When the rotatable disk 32 are rotated to make the locking bolt 33 move to the higher ends 325 of the two wedge-shaped components 323, the position-fixing blocks 332 is used together with the position-fixing concaves 327 to fix the position of the locking bolt 33.

The two second elastic components 35 are springs and respectively slipped on two poles 333 projecting from the upper portion of the two ends of the locking bolt 33. The second elastic components 35 are located between the fixing base 31 and the locking bolt 33. The lower ends of the second elastic components 35 is placed on the upper portions of the locking bolt 33 while the upper ends of the second elastic components 35 butt against tops of depressions 314 formed on the fixing base 31 respectively. The second elastic components 35 are used to push the locking bolt 33 downward. The two ends of the locking bolt 33 have two gear wheels 334 disposed thereon respectively. The gear wheels 334 mesh with the sawtooth-shaped slopes 324 of the two wedge-shaped components 323.

The bottom of the barrel 21 of the gun 2 has fixing slots 23. The fixing slots 23 are formed vertical to the barrel 21. The aiming device 1 is attached to the barrel 21 of the gun 2 by using the first directing tracks 312 together with the second directing tracks 22. When the aiming device 1 is placed to the predetermined position, one can rotate the rotatable disk 32 to make the locking bolt 33 move to the higher ends 325 of the two wedge-shaped components 323. Thus, the locking bolt 33 is moved upward to the higher position by the two wedge-shaped components 323 and pushed into the fixing slots 23 of the gun 2. In the meantime, the position-fixing blocks 332 is also pushed into the position-fixing concaves 327 to firmly fix the locking bolt 33 and thereby the aiming device 1 is surely fixed on a predetermined position of the barrel 21 of the gun 2. In this way, the aiming device 1 can be attached to the gun 2 speedily.

When one wants to detach the aiming device 1 from the gun 2, he only needs to rotate the rotatable disk 23 in the opposite direction. Rotating the rotatable disk 23 makes the lower ends 326 of the two wedge-shaped components 323 move to the underneath of the locking bolt 33 and the locking bolt 33 is moved downward to the lower position by the elasticity of the second elastic components 35. In this way, the locking bolt 33 is departed from the fixing slots 23 of the gun 2 and thereby the aiming device 1 can be detached from the gun 2 speedily.

In the present invention, the locking bolt 33 has the position-fixing blocks 332 disposed thereon and the higher ends 325 of the slopes 324 of the two wedge-shaped components 323 have the position-fixing concaves 327 formed thereon. When the rotatable disk 32 is rotated to make the higher ends 325 of the two wedge-shaped components 323 move to the underneath of the locking bolt 33, the position-fixing blocks 332 are pushed into the position-fixing concaves 327 to prevent the occurrence of relative movement between the locking bolt 33 and the wedge-shaped components 323. Thus, the locking bolt 33 is fixed at a predetermined position firmly. In this way, the locking bolt 33 is surely fixed on the gun 2 and the movement of the aiming device 1 is avoided when the attachment is completed.

Moreover, the second elastic components 35 are disposed between the locking bolt 33 and the fixing base 31. When one wants to detach the aiming device 1 from the gun 2, he only needs to rotate the rotatable disk in the opposite direction to make the lower ends 326 of the two wedge-shaped components 323 move to the underneath of the locking bolt 33. At this time, the locking bolt 33 is automatically moved downward to the lower position by elasticity of the second elastic components 35. In this way, the locking bolt 33 can be departed from the fixing slots 23 of the gun 2 surely and speedily. Thus, the aiming device 1 can be detached from the gun 2 speedily.

Although the present invention has been described with reference to the preferred embodiments thereof, it will be understood that the invention is not limited to the details thereof. Various substitutions and modifications have been suggested in the foregoing description, and others will occur to those of ordinary skill in the art. Therefore, all such substitutions and modifications are embraced within the scope of the invention as defined in the appended claims.

What is claimed is:

1. A structure for fixing an aiming device on a gun, the fixing structure being used for attaching the aiming device to the gun, the gun having a fixing slot, the fixing structure comprising:

a fixing base disposed fixedly on a top of the aiming device and formed with a containing room, wherein the fixing base is departably attached to the gun;

a rotatable disk rotatably disposed at a bottom of the fixing base, the rotatable disk having two wedge-shaped components projecting from a top surface thereof, each of the wedge-shaped components having a slope, the slope having a higher end and a lower end, the higher end of the slope formed with a position-fixing concave;

a locking bolt disposed within the containing room of the fixing base and capable of being moved upward or downward, the locking bolt having a lower portion formed with two position-fixing blocks; and two elastic components disposed between the fixing base and the locking bolt;

wherein the two wedge-shaped components push the locking bolt upward into the fixing slot of the gun, and the position-fixing blocks are placed correspondingly into the position-fixing concaves when the rotatable disk is rotated to make the higher ends of the two wedge-shaped components move to underneath of the locking bolt; and the locking bolt is pushed downward to a lower position by the two elastic components and thus departed from the fixing slot of the gun when the rotatable disk is rotated to make the lower ends of the two wedge-shaped components move to the underneath of the locking bolt.

2. The fixing structure as claimed in claim 1, wherein the containing room has two sides formed with a pair of first directing tracks and the gun has a pair of second directing tracks corresponding to the pair of first directing tracks, and the fixing base is attached to the gun by using the first directing tracks together with the second directing tracks.

3. The fixing structure as claimed in claim 1, wherein the rotatable disk has multiple indentations formed thereon and the fixing structure further has a pivotal component, and the pivotal component passes through a center of the rotatable disk and is fixed on the top of the aiming device to make the rotatable disk be disposed rotatably between the bottom of the fixing base and the top of the aiming device.

4. The fixing structure as claimed in claim 1, wherein the slopes of the wedge-shaped components are sawtooth-shaped.

5. The fixing structure as claimed in claim 4, wherein the locking component has two ends, each ends of the locking component has a gear wheel pivoted thereon, and the gear wheels pivoted on the locking component mesh with the sawtooth-shaped slopes of the wedge-shaped components.

6. The fixing structure as claimed in claim 1, wherein the locking component has two ends, each end of the locking component has a sliding component disposed thereon, the containing room of the fixing base has two sides formed with sliding slots, and the sliding components disposed on the two ends of the locking component are located within the sliding slots and capable of being moved upward or downward therein.

7. The fixing structure as claimed in claim 1, wherein the two elastic components are springs.

8. The fixing structure as claimed in claim 1, wherein the two elastic components are slipped respectively on two poles projecting from an upper portion of two ends of the locking bolt, and lower ends of the two elastic components are placed on the upper portion of the locking bolt and upper ends of the elastic components butt against tops of depressions formed on the fixing base.

9. The fixing structure as claimed in claim 1, further comprising a specific elastic component disposed between the aiming device and the rotatable disk, a lower end of the specific elastic component is placed on the top of the aiming device and an upper end of the specific elastic component butts against the bottom of the rotatable disk, and the two wedge-shaped components of the rotatable disk are pushed by the specific elastic component to contact the lower portion of the locking bolt constantly.

* * * * *